US006928849B1

(12) United States Patent
Yamada

(10) Patent No.: US 6,928,849 B1
(45) Date of Patent: Aug. 16, 2005

(54) METHOD OF MANUFACTURING HEAT EXCHANGING FIN AND DIE SET FOR MANUFACTURING THE SAME

(75) Inventor: Mamoru Yamada, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 121 days.

(21) Appl. No.: 10/665,486

(22) Filed: Sep. 22, 2003

(30) Foreign Application Priority Data

Dec. 26, 2002 (JP) ..... 2002-375686

(51) Int. Cl.[7] ..... B21D 53/04
(52) U.S. Cl. ..... 72/334; 72/356; 29/890.043
(58) Field of Search ..... 72/334, 356, 335; 29/890.043, 890.047

(56) References Cited

U.S. PATENT DOCUMENTS 1,642,166 A * 9/1927 McCaffrey ..... 72/324
1,724,486 A * 8/1929 Karmazin ..... 72/327
5,237,849 A * 8/1993 Miyazawa ..... 72/335
5,366,006 A * 11/1994 Lu et al. ..... 165/173
5,797,291 A * 8/1998 Yamada ..... 72/344
6,415,506 B1 * 7/2002 Baba et al. ..... 29/890.043
6,460,394 B2 * 10/2002 Hidaka et al. ..... 72/335

* cited by examiner

*Primary Examiner*—Daniel C. Crane
(74) *Attorney, Agent, or Firm*—Birch, Stewart, Kolasch & Birch, LLP

(57) ABSTRACT

The method of manufacturing a heat exchanging fin having an oval collared through-hole is capable of reducing manufacturing cost. The method comprises the steps of: forming a circular projected section, whose transverse sectional shape is a circular shape, in a thin metal plate; drawing the circular projected section a plurality of times so as to form into an oval projected section, whose transverse sectional shape is an oval shape and which has a prescribed height, a prescribed major axis and a prescribed minor axis; and boring a through-hole in the oval projected section so as to form the collared through-hole.

8 Claims, 6 Drawing Sheets

METHOD OF MANUFACTURING HEAT EXCHANGING FIN AND DIE SET FOR MANUFACTURING THE SAME

This nonprovisional application claims priority under 35 U.S.C. § 119(a) on Patent Application No. 2002-375686 filed in Japan on Dec. 26, 2002, which is herein incorporated by reference.

BACKGROUND OF THE INVENTION

The present invention relates to a method of manufacturing a heat exchanging fin having an oval collared through hole, in which an oval heat exchanging tube is inserted, and a die set for manufacturing said heat exchanging fin.

In a heat exchanger for a room air conditioner or a car air conditioner, a plurality of heat exchanging fins, which are made of, for example, thin aluminum plates, are piled. Each of the heat exchanging fins has a plurality of collared through-holes. Heat exchanging tubes are inserted in the collared through-holes. Generally, the heat exchanging tube is made of a high heat conductive material, e.g., copper.

Conventionally, tubes having oval transverse sectional shapes have been used as the heat exchanging tubes. Note that, the word "oval" means not only an elliptical shape but also an egg shape, and the "oval" shape has a major axis, a minor axis and no apexes.

A merit of the oval heat exchanging tubes will be explained. If the oval heat exchanging tubes are inserted in the oval collared through-holes of the heat exchanging fins so as to make an air streaming direction parallel to the major axes of the oval heat exchanging tubes, air can smoothly stream between the heat exchanging fins so that heat exchanging efficiency can be improved.

Conventionally, the heat exchanging fin having the oval collared through-holes is manufactured by drawing a thin metal plate. The method will be explained with reference to FIGS. 7A–7F.

In the step shown in FIG. 7A, an oval projected section 13, whose sectional shape is a trapezoidal shape of a square shape, is formed in the thin metal plate 10, e.g., a thin aluminum plate, by an oval drawing die and an oval drawing punch (not shown). A major axis and a minor axis of the oval projected section 13 are greater than those of a desired oval hole 12 (see FIG. 7F). To form the oval projected section 13, the oval drawing die and the oval drawing punch have oval transverse sectional shapes.

The oval projected section 13 formed in the step shown in FIG. 7A is further drawn in the steps shown in FIGS. 7B–7D so as to reduce the major axis and the minor axis. By the drawing steps, the oval projected section 13 is formed into an oval projected section 14 having a prescribed height, a prescribed major axis and a prescribed minor axis.

In the step shown in FIG. 7E, a through-hole is bored in an upper face of the oval projected section 14 by a pierce die and a pierce punch (not shown). By forming the through-hole, a collar section 15 is formed.

In the step shown in FIG. 7F, a front end of the collar section 15 is outwardly bent to form a flange section 16.

By above described steps, an oval collared through-hole 18 is formed in the thin plate 10.

In the conventional method, the oval projected section 13 is initially formed, then the oval projected section 13 is drawn several times (see FIGS. 7B–7D) to form the oval collared through-hole 18 having the prescribed size.

However, the oval drawing die and the oval drawing punch have complex shapes, so they must be more expensive than a circular drawing die and a circular drawing punch. Therefore, manufacturing cost must be higher; reduction of the cost of manufacturing the heat exchanging fin having the oval collared through-holes is required.

Further, in the conventional method, the oval projected section is drawn in each step shown in FIGS. 7B–7D, so that the size of the oval shape can be smaller. The oval shapes drawn in the steps shown in FIGS. 7B–7D are similar to the oval shape of the projected section 13 formed in the step shown in FIG. 7A. However, curvature of the oval shape is partially different, so thickness of the projected section is partially different, the projected section is apt to be cracked, and creases are formed in the thin plate.

A cause of those disadvantages will be explained with reference to FIG. 8.

In the oval projected section, curvature at an end 11 of the minor axis of the oval shape is different from curvature at en end 19 of the major axis thereof. If the oval projected is uniformly drawn with reduction width "d", drawing rate at the end 11 is different from that at the end 19. For example, the drawing rate "m (%)" at the end 19 of the major axis is m=100(h2/h1). On the other hand, the drawing rate "n (%)" at the end 11 of the minor axis is n=100(i2/i1). If the reduction width "d" is equal at the ends 11 and 19 (h1−h2=i1−i2=d), the drawing rate "m" at the end 19, at which the curvature of the oval shape is smaller, is less than the drawing rate "n" at the end 11, at which the curvature of the oval shape is greater. Therefore, even if the drawing can be executed at the end 11, the oval projected section is apt to be broken at the end 19.

SUMMARY OF THE INVENTION

The inventor of the present invention studied to solve the above described problems, and he found that a circular projected section can be formed into an oval projected section and that a first oval shape, which is shaped in a first drawing step, need not be similar to a desired oval shape, which will be shaped in a final drawing step.

An object of the present invention is to provide a method and a die set for manufacturing a heat exchanging fin having an oval collared through-hole with lower manufacturing cost.

To achieve the object, the present invention has following structures.

The method of the present invention comprises the steps of:

- forming a circular projected section, whose transverse sectional shape is a circular shape, in a thin metal plate;
- drawing the circular projected section a plurality of times so as to form into an oval projected section, whose transverse sectional shape is an oval shape and which has a prescribed height, a prescribed major axis and a prescribed minor axis; and
- boring a through-hole in the oval projected section so as to form the collared through-hole.

With this method, the circular projected section, which is firstly formed, has the circular transverse sectional shape, so it can be formed by a circular drawing die, whose transverse sectional shape is a circular shape, and a circular drawing punch, whose transverse sectional shape is a circular shape. By employing the circular die and punch, manufacturing cost of the heat exchanging fin can be reduced.

In the method, a ratio of the major axis of the oval projected section to the minor axis thereof may be gradually increased in the drawing steps.

In this case, the desired oval projected section can be easily formed. Further, the problems of uneven thickness, cracks, creases, etc., which are apt to be formed in the vicinity of the ends of the major axis, can be solved.

In the method, reduction of the minor axis of the oval projected section may be greater than that of the major axis thereof in each of the drawing steps.

In this case too, the desired oval projected section can be easily formed, and the problems of uneven thickness, cracks, creases, etc. can be solved.

In the method, a drawing rate at both ends of the minor axis of the oval projected section may be equal to that of the major axis thereof in each of the drawing steps.

In this case too, the desired oval projected section can be easily formed, and the problems of uneven thickness, cracks, creases, etc. can be further improved.

On the other hand, the die set of the present invention comprises:

an upper base;

a lower base relatively moving close to and away from the upper base;

a circular drawing die having a circular transverse sectional shape, the circular drawing die being provided to one of the bases;

a circular drawing punch having a circular transverse sectional shape, the circular drawing punch being provided to the other of the bases and capable of entering the circular drawing die so as to form a circular projected section in a thin metal plate;

a plurality of oval drawing dies having oval transverse sectional shapes, the oval drawing dies being provided to one of the bases;

a plurality of oval drawing punches having oval transverse sectional shapes, the oval drawing punches being provided to the other of the bases and capable of entering the corresponded oval drawing dies so as to reduce a width of the circular projected section and form the circular projected section into an oval projected section having a prescribed height; and a pierce punch being provided to one of the bases so as to form the oval projected section into the oval collared through-hole, wherein the oval drawing dies and the oval drawing punches are arranged so as to reduce a major axis and a minor axis of the oval projected section with advancing the steps of forming the oval projected section.

With this structure, the circular projected section, which is firstly formed, has the circular transverse sectional shape, can be formed by the circular drawing die and the circular drawing punch. Therefore, manufacturing cost of the heat exchanging fin can be reduced.

In the die set, the oval drawing dies and the oval drawing punches may be arranged so as to gradually increase a ratio of the major axis of the oval projected section to the minor axis thereof with advancing the steps of forming the oval projected section.

In this case, the desired oval projected section can be easily formed. Further, the problems of uneven thickness, cracks, creases, etc., which are apt to be formed in the vicinity of the ends of the major axis, can be solved.

In the die set, the oval drawing dies and the oval drawing punches may be designed so as to make reduction of the minor axis of the oval projected section greater than that of the major axis thereof. In this case too, the desired oval projected section can be easily formed, and the problems of uneven thickness, cracks, creases, etc. can be solved.

In the die set, the oval drawing dies and the oval drawing punches may be designed so as to make a drawing rate at both ends of the minor axis of the oval projected section equal to that of the major axis thereof.

In this case too, the desired oval projected section can be easily formed, and the problems of uneven thickness, cracks, creases, etc. can be further improved.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
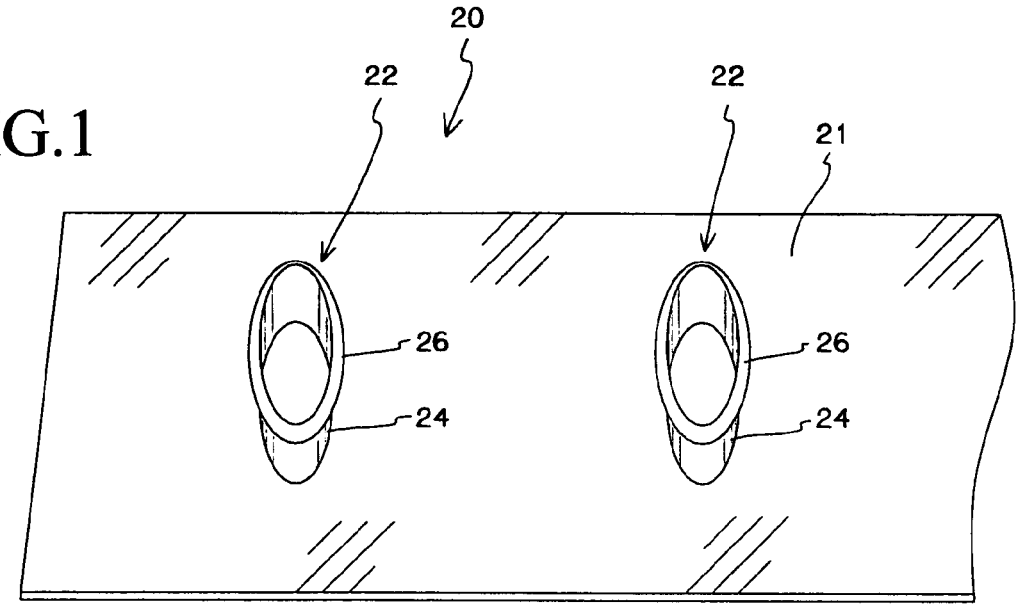
FIG. 1 is a perspective view of a heat exchanging fin manufactured by the method of the present invention.

FIG. 1 is a perspective view of a heat exchanging fin 20 manufactured by the method of the present invention.

The heat exchanging fin 20 includes a thin metal plate 21 made of, for example, aluminum, and a plurality of oval collared through-holes 22, each of which has an oval collar 24 having an oval transverse sectional shape. An oval heat exchanging tube (not shown), whose transverse sectional shape is an oval shape, will be inserted into each collared through-hole 22.

An upper end of each collar 24 is outwardly bent to form a flange 26. When a plurality of the heat exchanging fins 20 are piled to form a heat exchanger, the flanges 26 of the heat exchanging fin 20 located on the lower side contact and support the heat exchanging fin 20 located on the upper side.

A method of manufacturing the heat exchanging fin 20 will be explained with reference to FIG. 2, which is a plan view of the thin metal plate 21 in which the collared through-holes 22 are formed step by step.

Figure 2:
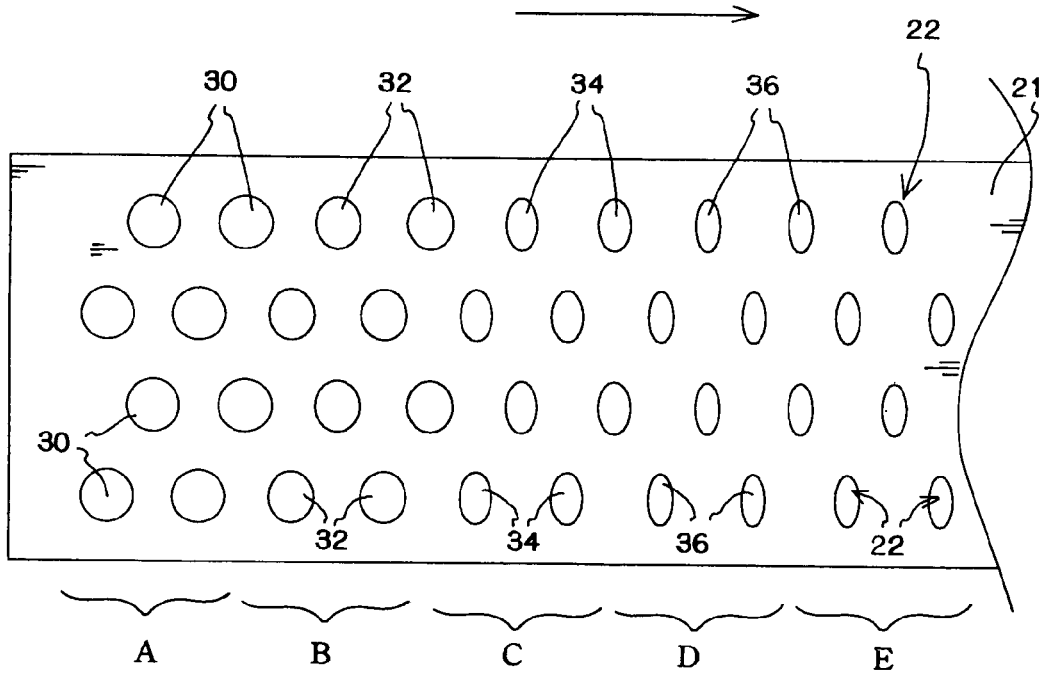
FIG. 2 is a plan view of a thin metal plate in which the collared through-holes are formed step by step.

In FIG. 2, the thin metal plate 21 is conveyed rightward to form the collared through-holes 22 step by step. When all of the collared through-holes 22 are formed in the thin metal plate 21, the thin metal plate 21 is cut along the lines of the collared through-holes 22 so as to form the heat exchanging fin 20 shown in FIG. 1.

The feature of the method of the present embodiment is to initially form circular projected sections 30, each of which has a circular transverse sectional shape, in the thin metal plate 21 and to gradually shape the circular projected sections 30 into oval projected sections.

In the method of the present embodiment, four drawing steps including the step of forming the circular projected sections 30 are executed. Note that, in FIG. 2, each step is executed twice with conveying the thin metal plate 21, because a die set of manufacturing the heat exchanging fins has two sets of dies and punches for each step, and they are arranged in the conveying direction.

Firstly, in a first drawing step "A", the projected sections 30 having the circular transverse shapes are formed in the thin metal plate 21.

Next, in a second drawing step "B", the circular projected sections 30 are formed into oval projected sections 32, each of which has a slightly oval transverse sectional shape. The oval sectional shape has a major axis and a minor axis.

In a third drawing step "C", the size of the oval sectional shapes are made small. The major axis and the minor axis of the oval projected sections 32 are slightly shortened to form the oval projected sections 34. Note that, in each oval projected section 34, reduction of length of the minor axis is greater than that of the major axis. Namely, RLa>RLb (see FIG. 3).

In a fourth or final drawing step "D", the size of the oval sectional shapes are further made small. The major axis and the minor axis of the oval projected sections 34 are further shortened to form the oval projected sections 36. Note that, in each oval projected section 36 too, the reduction of length of the minor axis is greater than that of the major axis (RLa>RLb). The drawing steps are completed.

After the oval projected sections 36 having desired height and shape are formed, a piercing step "E" is executed. Namely, through-holes are respectively bored in upper faces of the oval projected sections 36. Further, inner faces of the oval projected sections 36 are burred. By boring and burring the through-holes, the collared through-holes 22 having a prescribed height can be formed.

After the piercing step "E", the upper ends of the collared through-holes 22 are outwardly bent to form the flanges 26 in a flaring step (not shown).

In each of the steps "B" to "D", the oval shapes of the projected sections 32 and 34 are not similar to that of the oval projected sections 36. Namely, the reduction of length of the minor axis is greater than that of the major axis (RLa>RLb). Further, in each of the steps "B" to "D", a drawing rate at both ends of the minor axis of each oval projected section is equal to that of the major axis thereof. Note that, the word "drawing rate" is equal to that explained in BACKGROUND OF THE INVENTION.

Figure 3:
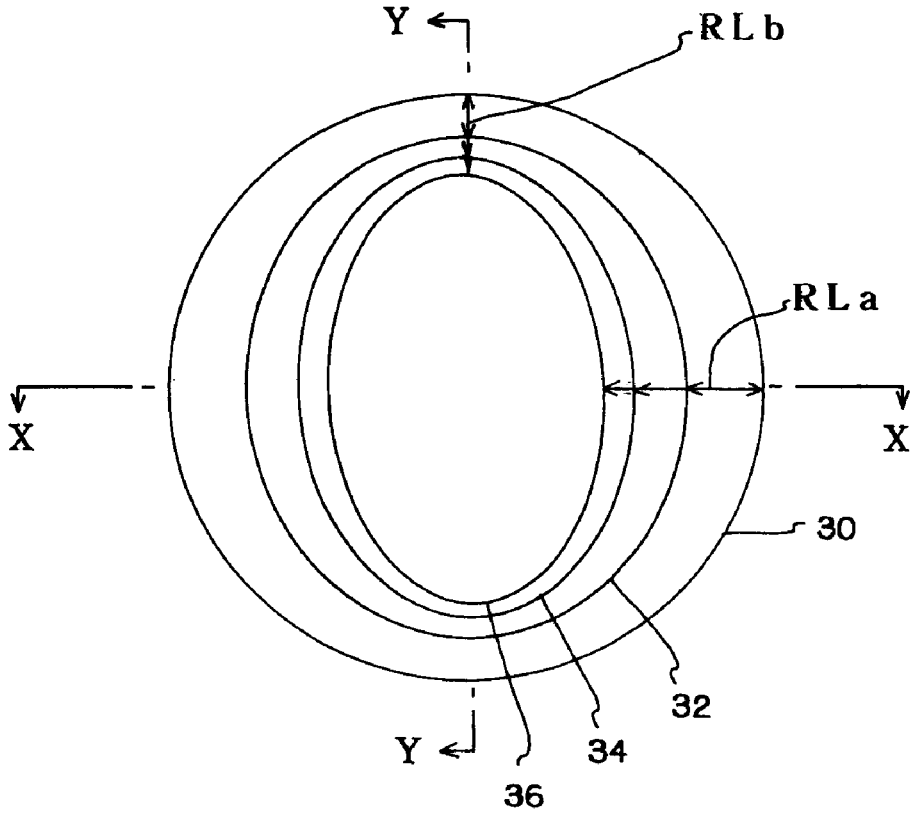
FIG. 3 is an explanation view of projected sections, in which the projected sections of each drawing step are coaxially shown.
Figure 4:
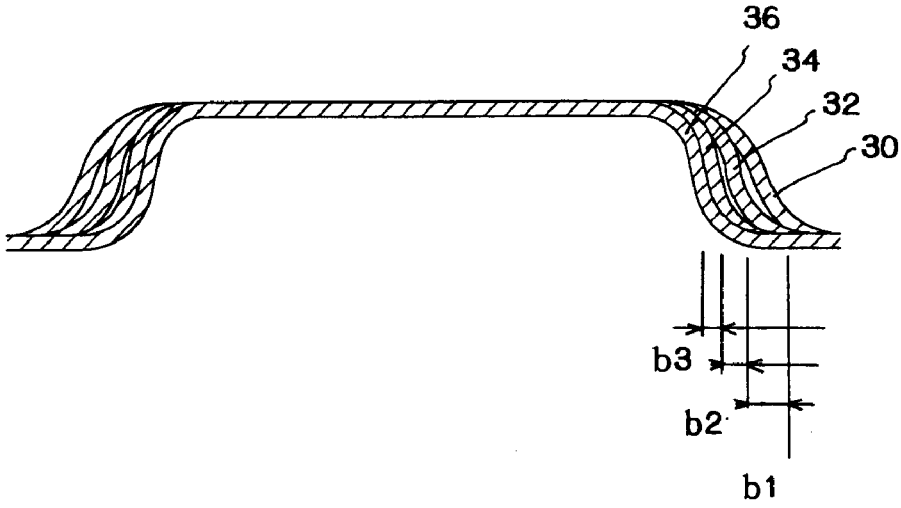
FIG. 4 is a sectional view taken along a line Y—Y shown in FIG. 3.
Figure 5:
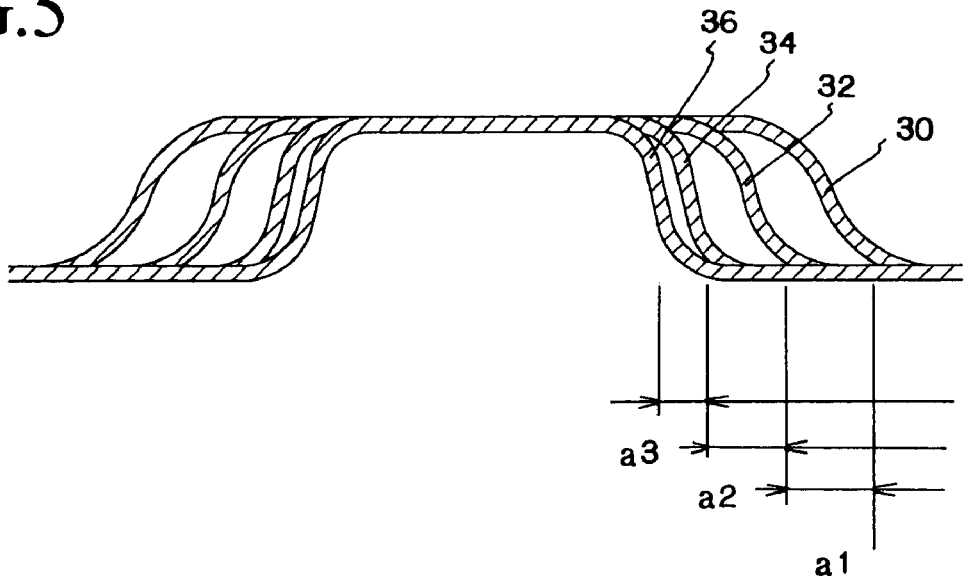
FIG. 5 is a sectional view taken along a line X—X shown in FIG. 3.

Details of the drawing steps will be explained with reference to FIGS. 3–5. FIG. 3 is an explanation view of projected sections, in which plan views of the projected sections 30, 32, 34 and 36 are coaxially shown for comparison; FIG. 4 is a sectional view taken along a line Y—Y shown in FIG. 3; and FIG. 5 is a sectional view taken along a line X—X shown in FIG. 3. Note that, in FIGS. 4 and 5, height of the projected sections 30, 32, 34 and 36 are equal, but actual heights are slightly varied with advancing the drawing steps.

When the circular projected section 30 is drawn and formed into the oval projected section 32, the reduction of the minor axis is "a1" and the reduction of the major axis is "b1" (a1>b1). Therefore, the circular sectional shape of the projected section 30 is formed into the oval sectional shape.

When the oval projected section 32 is drawn and formed into the oval projected section 34, the reduction of the minor axis is "a2" and the reduction of the major axis is "b2" (a2>b2).

When the oval projected section 34 is drawn and formed into the oval projected section 36, the reduction of the minor axis is "a3" and the reduction of the major axis is "b3" (a3>b3).

In the present embodiment, the oval shapes of the projected sections 32 and 34 are not similar to that of the desired oval projected sections 36; the reduction of length of the minor axis is greater than that of the major axis (RLa>RLb); a ratio of the major axis to the minor axis is gradually increased in the drawing steps "B" to "D"; and the drawing rate at both ends of the minor axis of each oval projected section is equal to that of the major axis thereof in each of the drawing steps "B" to "D". Therefore, the problems of the conventional method can be solved.

If the oval shape of the projected section 32 or 34 is similarly drawn with respect to the desired projected section 36, the drawing rate at the ends of the major axis are small, so that the projected section is apt to be broken thereat. However, in the present embodiment, the reduction of length of the minor axis is greater than that of the major axis (RLa>RLb), and the drawing rate at both ends of the minor axis of each oval projected section is equal to that of the major axis thereof, so that the whole projected section can be uniformly and smoothly drawn.

Figure 6:
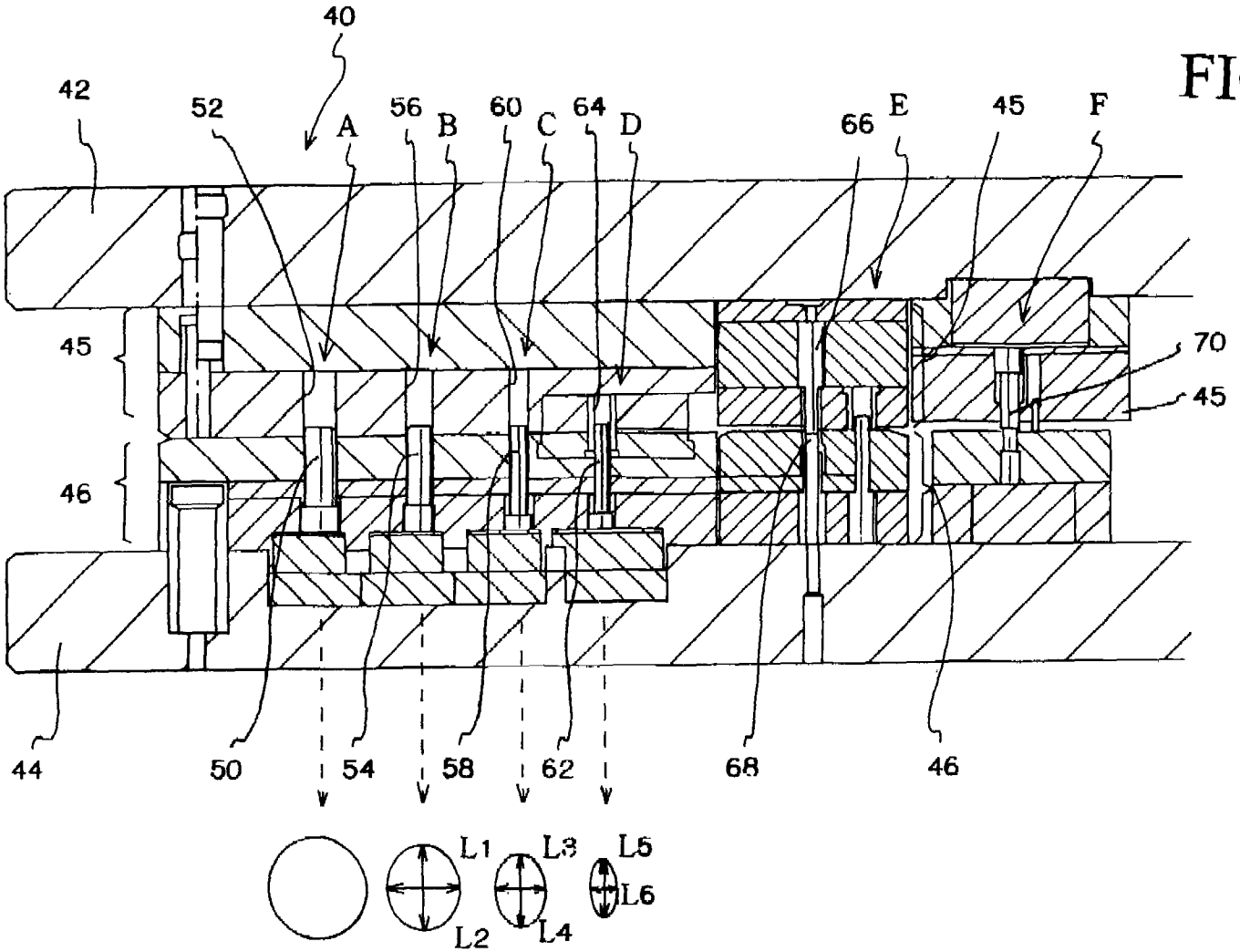
FIG. 6 is a sectional view of a die set of an embodiment of the present invention.
Figure 7A:
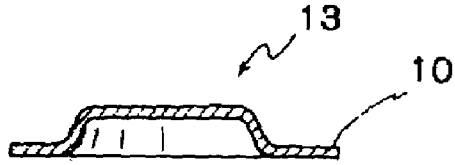
FIG.7A PRIOR ART
FIGS. 7A–7F are explanation views showing the conventional methods of manufacturing the heat exchanging fin having oval collared through-holes.
Figure 7B:
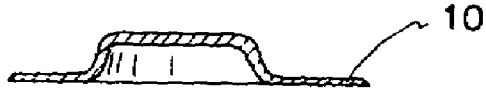
FIG.7B PRIOR ART
Figure 7C:
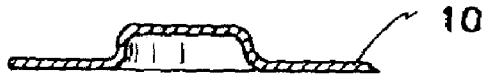
FIG.7C PRIOR ART
Figure 7D:
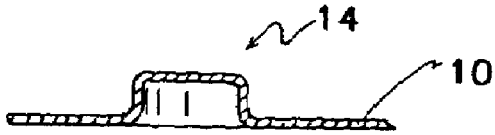
FIG.7D PRIOR ART
Figure 7E:
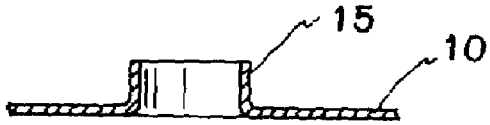
FIG.7E PRIOR ART
Figure 7F:
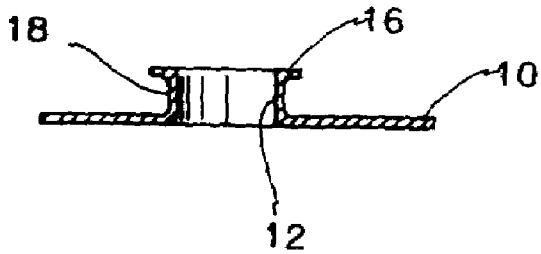
FIG.7F PRIOR ART
Figure 8:
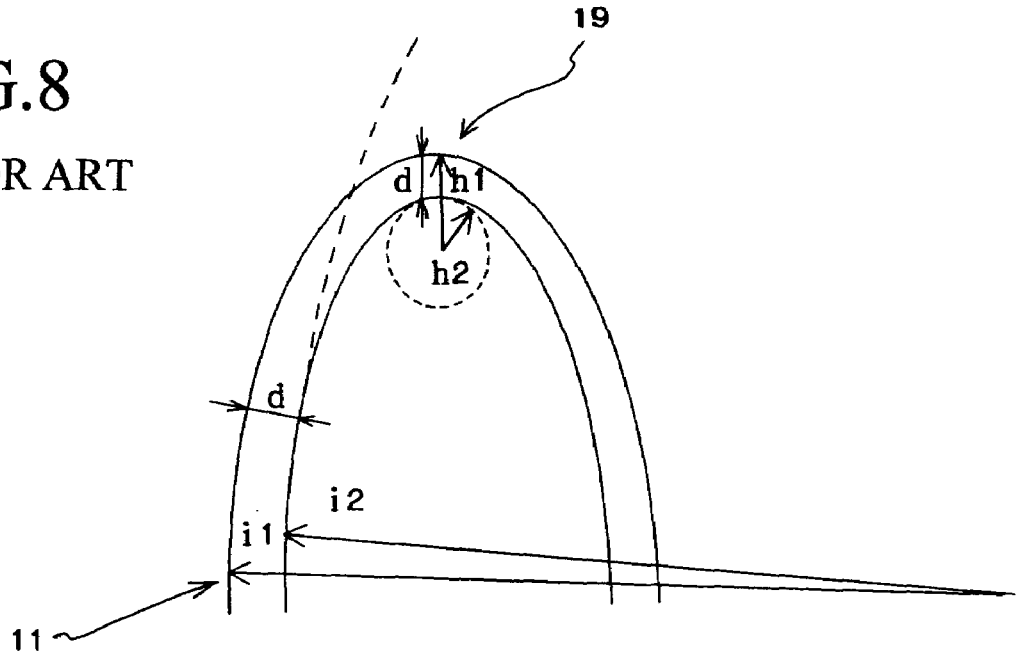
FIG.8 PRIOR ART
FIG. 8 is an explanation view explaining drawing rate in the conventional method.

A die set of an embodiment of the present invention is shown in FIG. 6.

The die set 40 for manufacturing the heat exchanging fins. In FIG. 6. the thin metal plate (not shown) is conveyed rightward in the die set 40 so as to execute the drawing steps of the method of the present invention. Namely, truncated cone-shaped projected sections are formed in the thin metal plate, and they are drawn in a plurality of the drawing steps "A" to "D", in the die set 40, so as to form the collared through-holes having prescribed height and size. Further, the piercing step "E", in which boring the through-holes and burring the inner faces are executed, and the flaring step "F", in which the flanges are formed at the upper ends of the collars, are performed in the die set 40.

Note that, means for cutting the thin metal plate to form the heat exchanging fins is not shown in FIG. 6.

The die set 40 includes an upper base holder 42 and a lower base holder 44. At least one of the base holders 42 and 44 is vertically moved close to and away from the other. An upper base 45 and a lower base 46 are respectively provided to the base holders 42 and 44, and the bases 45 and 46 face each other.

Dies, punches and tools for each steps "A" to "F" are provided to the bases 45 and 46.

For the drawing step "A", a circular drawing punch 50 having a circular transverse sectional shape is provided to the lower base 46; a circular drawing die 52 having a circular transverse sectional shape is provided to the upper base 45. When the bases 45 and 46 are closed, the circular drawing punch 50 enters the circular drawing die 52 so as to form the circular projected section 30 in the thin metal plate 21.

For the drawing step "B", an oval drawing punch 54 having an oval transverse sectional shape is provided to the lower base 46; an oval drawing die 56 having an oval transverse sectional shape is provided to the upper base 45. When the bases 45 and 46 are closed, the oval drawing punch 54 enters the oval drawing die 56 so as to reduce width of the circular projected section 30, form the circular projected section 30 into the oval projected section 32 and make its height higher.

For the drawing step "C", an oval drawing punch 58 having an oval transverse sectional shape is provided to the lower base 46; an oval drawing die 60 having an oval transverse sectional shape is provided to the upper base 45. When the bases 45 and 46 are closed, the oval drawing punch 58 enters the oval drawing die 60 so as to reduce width of the oval projected section 32, form the oval projected section 32 into the oval projected section 34 and make its height higher.

For the drawing step "D", an oval drawing punch 62 having an oval transverse sectional shape is provided to the lower base 46; an oval drawing die 64 having an oval transverse sectional shape is provided to the upper base 45. When the bases 45 and 46 are closed, the oval drawing punch 62 enters the oval drawing die 64 so as to reduce width of the oval projected section 34, form the oval projected section 34 into the desired oval projected section 36 with a prescribed height.

The oval drawing dies 56, 60 and 64 and the oval drawing punches 54, 58 and 62 are arranged so as to reduce the major axis and the minor axis of the oval projected section with advancing the drawing steps "B" to "D".

A major axis and a minor axis of the oval drawing punch 54 are shorter than a diameter of the circular drawing punch 50. Especially, reduction length of the minor axis is greater than that of the major axis.

In the oval drawing die 56 too, reduction length of a minor axis is greater than that of a major axis as well as the oval drawing punch 54.

A major axis and a minor axis of the oval drawing punch 58 are shorter than those of the oval drawing punch 54, but a transverse sectional shape of the oval drawing punch 58 is not similar to that of the oval drawing punch 54. Reduction length of the minor axis is greater than that of the major axis.

In the oval drawing die 60 too, reduction length of a minor axis is greater than that of a major axis with respect to the oval drawing die 56.

A major axis and a minor axis of the oval drawing punch 62 are shorter than those of the oval drawing punch 58, but a transverse sectional shape of the oval drawing punch 62 is not similar to that of the oval drawing punch 58. Reduction length of the minor axis is greater than that of the major axis.

In the oval drawing die 64 too, reduction length of a minor axis is greater than that of a major axis with respect to the oval drawing die 60.

A ratio of the major axis "L3" of the oval drawing punch 58 and the oval drawing die 60 to the minor axis "L4" thereof is greater than a ratio of the major axis "L1" of the oval drawing punch 54 and the oval drawing die 56 to the minor axis "L2" thereof (L3:L4>L1:L2). Further, a ratio of the major axis "L5" of the oval drawing punch 62 and the oval drawing die 64 to the minor axis "L6" thereof is greater than the ratio of the major axis "L3" of the oval drawing punch 58 and the oval drawing die 60 to the minor axis "L4" thereof (L5:L6>L3:L4).

For the piercing step "E", a pierce punch 66 for boring a through-hole in the upper face of the oval projected section 36 is provided to the upper base 45.

A burring punch 68 is provided to the lower base 46. The burring punch 68 receives a lower end of the pierce punch 66 and enters the oval projected section 36 so as to bur the inner face of the oval projected section 36. By burring the inner face of the oval projected section 36, the collar 24 is formed.

For the flaring step "F", a flaring punch 70 for outwardly bending the upper end of the collar 24 is provided to the upper base 45. By outwardly bending the upper end of the collar 24, the flange 26 can be formed.

In the die set 40 of the present embodiment, each of the drawing steps "A" to "D" is executed once, but each drawing step may be executed twice as well as the embodiment shown in FIG. 2. In this case, two sets of the drawing dies and drawing punches for each drawing step are serially arranged in the direction of conveying the thin meta plate 21, and a pitch of conveying the thin metal plate 21 after opening the bases 45 and 46 is longer.

In the above described embodiments, four drawing steps "A" to "D" including the drawing step "A" for forming the circular projected sections 30 are executed so as to form the desired oval projected sections 36. However, number of the drawing steps is not limited to four, so the number of the drawing steps including the drawing step for forming the circular projected sections may be three or five or more.

The invention may be embodied in other specific forms without departing from the spirit or essential characteristics thereof. The present embodiments are therefore to be considered in all respects as illustrative and not restrictive, the scope of the invention being indicated by the appended claims rather than by he foregoing description and all changes which come within the meaning and range of equivalency of the claims are therefore intended to be embraced therein.

What is claimed is:

1. A method of manufacturing a heat exchanging fin having an oval collared through-hole, comprising the steps of:

forming a circular projected section, whose transverse sectional shape is a circular shape, in a thin metal plate;

drawing said circular projected section a plurality of times so as to form into an oval projected section, whose transverse sectional shape is an oval shape and which has a prescribed height, a prescribed major axis and a prescribed minor axis; and boring a through-hole in said oval projected section so as to form said collared through-hole.

2. The method according to claim 1, wherein a ratio of the major axis of said oval projected section to the minor axis thereof is gradually increased in said drawing steps.

3. The method according to claim 1, wherein reduction of the minor axis of said oval projected section is greater than that of the major axis thereof in each of said drawing steps.

4. The method according to claim 1, wherein a drawing rate at both ends of the minor axis of said oval projected section is equal to that of the major axis thereof in each of said drawing steps.

5. A die set for manufacturing a heat exchanging fin having an oval collared through-hole, comprising:

an upper base;

a lower base relatively moving close to and away from said upper base;

a circular drawing die having a circular transverse sectional shape, said circular drawing die being provided to one of said bases;

a circular drawing punch having a circular transverse sectional shape, said circular drawing punch being provided to the other of said bases and capable of entering said circular drawing die so as to form a circular projected section in a thin metal plate;

a plurality of oval drawing dies having oval transverse sectional shapes, said oval drawing dies being provided to one of said bases;

a plurality of oval drawing punches having oval transverse sectional shapes, said oval drawing punches being provided to the other of said bases and capable of entering said corresponded oval drawing dies so as to reduce a width of the circular projected section and form the circular projected section into an oval projected section having a prescribed height; and a pierce punch being provided to one of said bases so as to form the oval projected section into the oval collared through-hole, wherein said oval drawing dies and said oval drawing punches are arranged so as to reduce a major axis and a minor axis of the oval projected section with advancing the steps of forming the oval projected section.

6. The die set according to claim 5, wherein said oval drawing dies and said oval drawing punches are arranged so as to gradually increase a ratio of the major axis of the oval projected section to the minor axis thereof with advancing the steps of forming the oval projected section.

7. The die set according to claim 5, wherein said oval drawing dies and said oval drawing punches are designed so as to make reduction of the minor axis of said oval projected section greater than that of the major axis thereof.

8. The die set according to claim 5, wherein said oval drawing dies and said oval drawing punches are designed so as to make a drawing rate at both ends of the minor axis of said oval projected section equal to that of the major axis thereof.

* * * * *